US005240297A

United States Patent [19]

Lee

[11] Patent Number: 5,240,297

[45] Date of Patent: Aug. 31, 1993

[54] TAMPERPROOF BAG SECURITY SEAL

[76] Inventor: Leon L. M. Lee, 15/F., Caltex House, 258 Hennessey Road, Wanchai, Hong Kong

[21] Appl. No.: 737

[22] Filed: Jan. 5, 1993

[51] Int. Cl.[5] ..... B65D 33/34

[52] U.S. Cl. ..... 292/308

[58] Field of Search ..... 292/308, 309, 311, 312, 292/313, 315

[56] References Cited

U.S. PATENT DOCUMENTS

| | | | |
|---|---|---|---|
| 181,599 | 8/1876 | Schneider | 292/309 |
| 676,415 | 6/1901 | Brooks | 292/313 |
| 1,168,830 | 1/1916 | Sismondi | 292/309 |
| 3,292,961 | 12/1966 | Moberg | 292/311 |
| 5,087,089 | 2/1992 | Lee | 292/308 |

*Primary Examiner*—Richard E. Moore

*Attorney, Agent, or Firm*—Antonelli, Terry, Stout & Kraus

[57] ABSTRACT

A tamperproof security seal for a container which includes an outer cover member having a closed end wall with a plurality of through-holes therein. A locking member is adapted to be accommodated in the outer cover member with the locking member being formed of a sheet steel and having a plurality of rows of openings extending across a width of the locking member. The openings in each row are spaced from each other in a longitudinal direction of the locking member and are in axial alignment with each other and to the respective rows are in axial alignment with the respective openings of the end wall of the cover member. A drawstring is threaded through the openings in the locking member and the outer cover member so as to form a loop portion adapted to be placed over an opening of the container. Upon a crimping of the seal, the outer cover member and locking member are deformed so that edges of the openings of the locking member firmly grip the drawstring thereby forming individual anchoring points on the drawstring so as to prevent withdraw of the drawstring from the seal member and prevent unauthorized access to the container.

9 Claims, 2 Drawing Sheets

TAMPERPROOF BAG SECURITY SEAL

FIELD OF THE INVENTION

The present invention relates to a seal and, more particularly, to a tamperproof security seal for sealing bags or pouches such as, for example, currency bags, mail bags or the like.

BACKGROUND OF THE INVENTION

Various types of security seals for sealing bags or the like have been proposed and, for example, the most common security seal consists essentially of a lead seal member having a plurality of through-holes therein through which a drawstring or the like is serially passed, with the lead seal member being subsequently crimped by a crimping tool so as to secure the drawstrings around an opening of the bag and thereby prevent access thereto.

One disadvantage of the conventional lead type security seal resides in the fact that, if the seal is not properly crimped, it is possible to loosen the drawstring sufficiently to gain access to the bag without moving the drawstring, tamper with the contents of the bag, and redraw the drawstring without providing an evidence of tampering.

Another disadvantage of the lead seal resides in the fact that the seal is not reusable and, to gain authorized entry, the lead seal member is generally severed and discarded.

U.S. Pat. No. 4,342,477 proposes a security seal with a break-off screwhead securement wherein a block shaped retainer is provided with through-holes so as to permit a passage of a drawstring, with a manual anchoring of the tie member and the retainer being accomplished by engagement of a working end of a screw head against the drawstring, with the head of the screw then being broken off and discarded.

Recently, more attention has been given to environmental issues. There is a considerable concern relating to the use of lead and to the subsequent disposal thereof. Thus, attempts have been made to provide a seal arrangement which ensures security but which is fashioned from a material which is less detrimental to the environment than lead.

For example, U.S. Pat. Nos. 4,223,424, 4,306,745, 4,333,210, 4,365,833, 4,610,053, 4,676,535 and 4,895,402, various types of security seals are proposed which are fashioned of a plastic material.

A common disadvantage shared by the above-noted proposed seals resides in the fact that they are all multipartite and, consequently, not only relatively expensive to manufacture and assemble, but also somewhat difficult to manipulate when being applied to the bag to be sealed, in addition to not necessarily precluding a tampering of the contents of the sealed bag.

Other arrangements are proposed in U.S. Pat. Nos. 331,439, 990,629, 2,899,230, 2,314,814 and 2,496,905.

Additionally, U.S. Pat. No. 5,087,089 proposes a bag security seal wherein a seal member includes a plurality of partition walls disposed in parallel to one another and in parallel to end wall sections so as to define a plurality of channels extending across a width of the seal member. A plurality of aligned holes are provided in the each of the partition walls and end wall sections, with the holes extending through the partition walls and the end wall sections in a direction perpendicular to a longitudinal center axis of the respective channels. The holes in the partition walls and the end wall sections are disposed in alignment so as to enable a drawstring to be threaded therethrough in such a manner that a looped portion is formed on one side of the seal member and is adapted to be placed around the container, with free ends of the drawstring being disposed on an opposite side of the seal member. Upon a crimping of the seal member, the partition walls and end wall sections are deformed so that openings form individual anchoring points on the drawstring so as to prevent a withdraw of the drawstring from the seal member and to prevent unauthorized access to the container.

The security seal of U.S. Pat. No. 5,087,089 is formed of a soft material such an aluminum or aluminum alloy and, while the seal of this patent provides a significantly improved tamperproof seal arrangement as compared with the prior art, it has been determined that there is a possibility that the seal may be altered by virtue of the fashioning of the seal of a soft material.

SUMMARY OF THE INVENTION

The aim underlying the present invention essentially resides in providing an improved security seal for a bag or the like which ensures a firm anchoring of the seal to the bag and prevents any tampering with the contents of the bag thereof.

In accordance with advantageous features of the present invention, a tamperproof security seal for a container is provided with the tamperproof security seal including an outer cover member having a closed end wall and being opened at an opposite end. A plurality of through-holes are provided in the closed end wall, and a locking member is adapted to be accommodated in the outer cover member. The locking member is formed as a sheet metal member having a plurality of rows of openings extending across a width of the locking member, with the openings in each row being spaced from each other in a longitudinal direction of the locking member and being in axial alignment with each other in the respective rows. The respective rows of axially aligned opening are in alignment with respective openings in the end wall of the cover member. The openings in the locking member and end wall of the outer cover member are arranged such that a drawstring is threaded through the openings in the locking member and the outer cover member so as to form a loop portion on one side of the seal, which loop portion is adapted to be placed around an opening of the container, with free ends of the drawstring being disposed on opposite sides of the seal. Upon a crimping of the seal, the outer cover member and the locking member are deformed so that the edges of the respective opening in each of the rows of the openings of the sheet metal member firmly grip the drawstring thereby forming individual anchoring points on the drawstring so as to prevent withdraw of the drawstring from the seal member and prevent unauthorized access to the container.

In accordance with the present invention, the openings in the locking member are defined by a plurality of undulations formed in the sheet metal member, with the undulations extending from opposite sides of a plane of the sheet metal member so as form the rows of openings. Upon a crimping, the edges of the openings firmly grip portions of the drawstring so as to preclude any possible withdraw of the drawstring without either completely destroying the seal or severing the drawstring so as to gain access to the container.

Advantageously, the outer cover member is formed of a thermoplastic material which, upon crimping, deforms about the locking member and provides a means whereby a visual inspection would readily determine an unauthorized tampering with the seal.

The locking member is advantageously formed of sheet steel, which is simultaneously punched to form the undulations with the simultaneous punching occurring by offset punches, so as to form the rows of openings extending across a width of the locking member.

The above and other objects, features and advantages of the present invention will become more apparent from the following description when taken in connection with the accompanying drawings which show, for the purposes of illustration only, one embodiment in accordance with the present invention.

DETAILED DESCRIPTION

Figure 6:
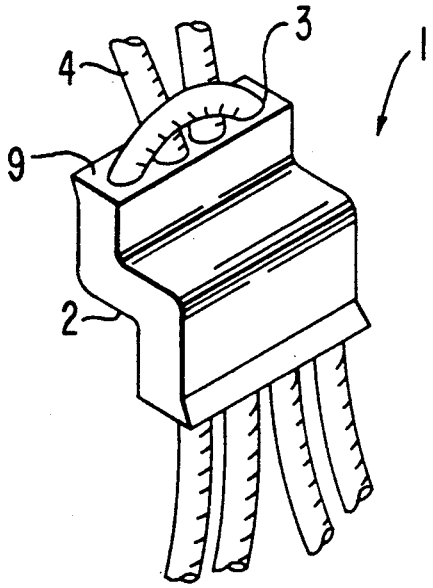
FIG. 6 is a perspective view of the seal assembly of the present invention in a crimped condition.
Figure 7:
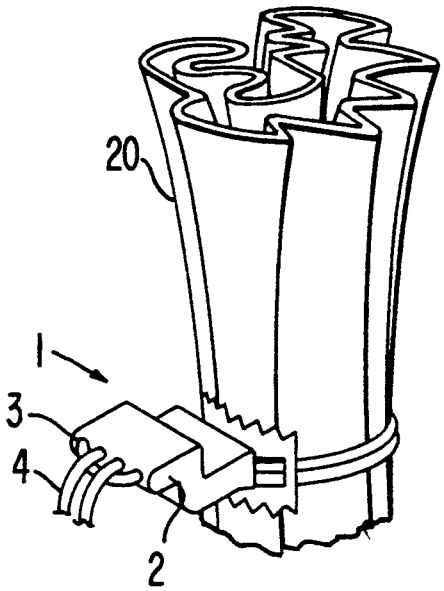
FIG. 7 is a perspective view of the seal assembly of FIG. 1 in the crimped condition applied to a container such as a pouch or bag.

Referring now to the drawings wherein like reference numerals are used throughout the various views to designate like parts and, more particularly, to FIGS. 1–4, in accordance with the present invention, a tamperproof seal generally designated by the reference numeral 1 includes an outer cover member 2, fashioned, for example, with a thermoplastic material. The outer cover member 2 includes an end wall 9 having a plurality of through-holes or openings 3, with an opposite end of the outer cover member 3 being open so as define a chamber 8 for accommodating a locking member generally designated by the reference numeral 5. The seal 1 is adapted to seal a neck of a container 20 (FIG. 6) such as, for example, a currency bag or security pouch, by tightly drawing a drawstring 4 placed around the neck of the container 20 so as to close the bag 20 with the seal 1 then being crimped by a conventional crimping tool (not shown) of the type disclosed, for example, in U.S. Pat. No. 3,911,970, thereby resulting in the seal 1 being deformed and assuming the configuration shown in FIGS. 6 and 7.

Figure 1:
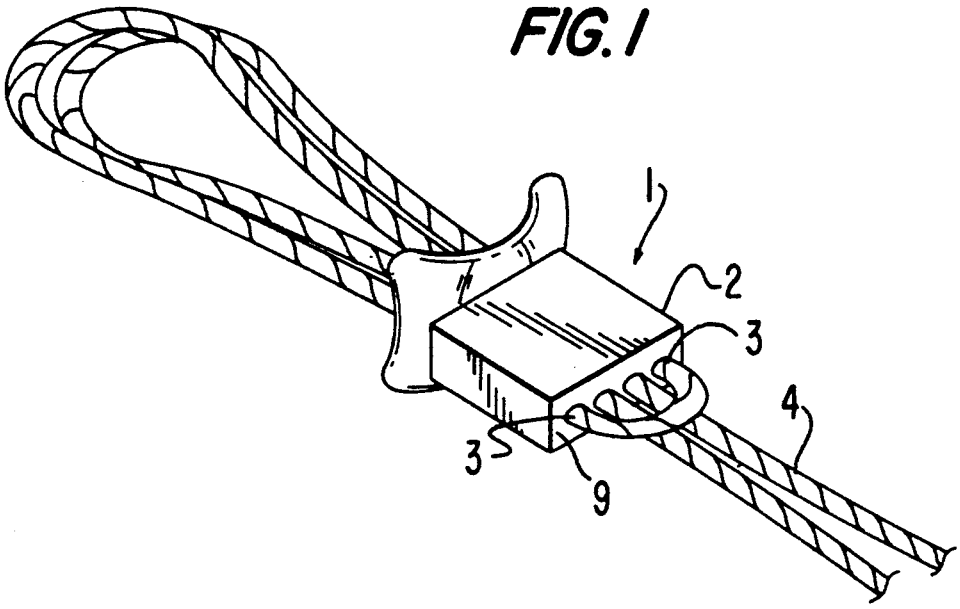
FIG. 1 is a perspective view of a tamperproof seal assembly constructed in accordance with the present invention.
Figure 2:
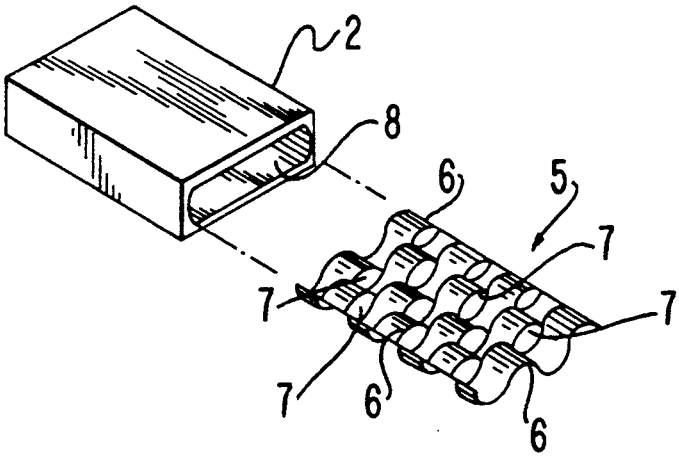
FIG. 2 is an exploded perspective view of the seal elements of the assembly of FIG. 1.
Figure 3:
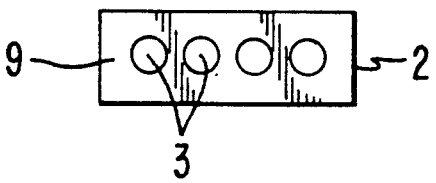
FIG. 3 is an end view of an outer cover member of the seal of the present invention.
Figure 4:
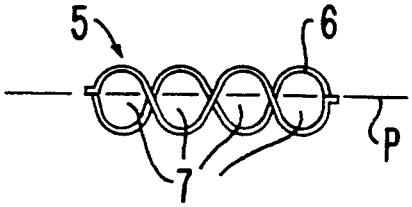
FIG. 4 is an end view of a sealing or locking element of the seal of the present invention.

As shown in FIG. 2, the locking member 5 is formed from a sheet metal member having a plurality of undulations extending in opposite sides of a plane P (FIG. 4) of the locking member 5. The oppositely disposed undulations form or define a plurality of rows of openings 7 extending across a width of the locking member 5, with the openings 7 in each row being aligned in a longitudinal direction of the locking member 5 and with the respective rows of the aligned openings 7 being respectively aligned with the openings 3 in the end wall 9 so as to permit a threading of the drawstring 4 through the locking member 5 and the end wall 9 of the outer cover member 2. As shown in FIG. 2, the openings 7 are spaced from each other in a longitudinal direction and are offset with respect to one another in a direction of the width of the locking member 5. While FIG. 2 provides an example of an undulation arrangement wherein twenty-eight undulations are provided for defining the openings 7, it is understood that, for example, twenty undulations may be provided for defining the openings depending upon the type of securement desired. However, with the provision of the twenty-eight undulations, it is possible to ensure that the drawstring 4 will be tightly and securely attached to the container or pouch 20 and any attempt to remove the drawstring 4 will result in a severing or cutting of the drawstring 4 thereby clearly revealing any attempted tampering with the contents of the container or pouch 20.

Figure 5:
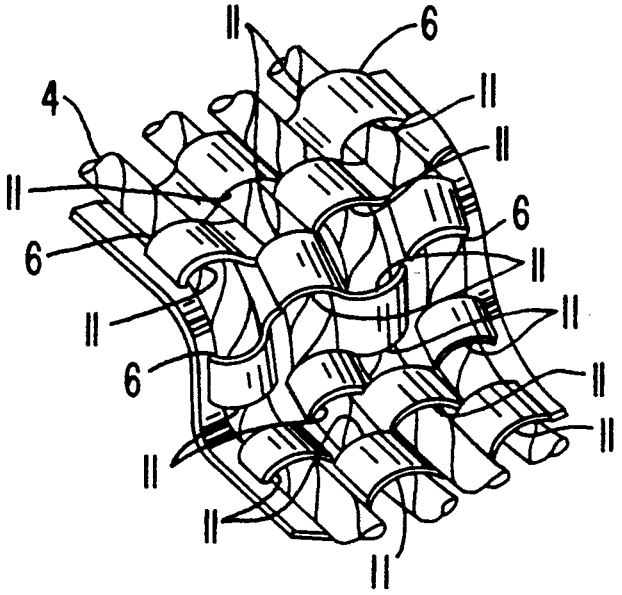
FIG. 5 is a perspective view of a crimped seal of the present invention with the outer cover element removed.

FIG. 5 provides an illustration of the deformation of the locking member 5 upon a crimping of the seal 1. More particularly, as shown in FIG. 5, when the seal 1 is crimped, the edges 6 of the respective openings 7 firmly grip the drawstring 4 and, at the point of gripping, provide individual anchoring points 11 on the drawstring which anchoring points prevent any withdrawal of the drawstring 4 from the locking member 5 thereby preventing unauthorized access to the container or pouch 20.

By virtue of the fact that the locking member is fashioned of sheet steel, the anchoring achieved by the edges 6 of the openings 7 grip the drawstring s tightly that it is virtually impossible to loosen the locking member 5 so as to permit withdraw of the drawstring 4. Moreover, the deformation of the thermoplastic material of the outer cover member 2 also provides a means for securing the drawstring 4 and to enable a visual ascertaining of the integrity of the crimped seal 1.

Advantageously, the locking member is fashioned of steel having the following percentage by weight, approximately 93.7% Fe, 2.1% Mn, 2% C, 1.4% P, and 0.8% S.

To manufacture the seal member of the present invention, the outer cover member 2 may, for example, be fashioned by suitable injection molding and the locking member 5 can be produced by subjecting a sheet steel member to a punching operation wherein punches, disposed on opposite sides of the sheet steel member with the punches being offset with respect to one another to simultaneously punch the undulations resulting in the undulations being formed on opposite sides of the plane P of the locking member 5. The sheet metal member is then subjected to a cutting or severing operation so as to arrive at the desired size of the locking member, which size enables the insertion of the locking member 5 into the chamber 8 of the outer cover member 2. The drawstring 4 is then threaded through the opening in the manner illustrated in the drawings so as to form the loop portion adapted to be placed around the opening of the container 20.

While I have shown and described only one embodiment in accordance with the present invention, it is understood that the same is not limited thereto, but is susceptible to numerous changes and modifications, as known to one of ordinary skill in the art, and I therefore do not wish to be limited to the details shown and described herein, but intend to cover all such modifications as are encompassed by the scope of the appended claims.

I claim:

1. A tamperproof security seal for a container, the tamperproof security seal comprising:

an outer cover member having a closed end wall and being open at an end opposite said closed end wall;

a plurality of through-holes provided in said closed end wall of said outer cover member;

a locking member adapted to be accommodated in said outer cover member, said locking member being formed of a sheet metal having a plurality of rows of openings extending across a width of the locking member, the openings in each row being spaced from each other in a longitudinal direction of the locking member and being in axial alignment with each other and with the respective rows of openings being in axial alignment with the respective openings in the end wall of the outer cover member, such that a drawstring is threaded through the openings in the locking member and openings in the end wall of the outer cover member so as to form a loop portion on one side of the seal adapted to be placed around an opening of the container, with free ends of the drawstring being disposed on an opposite side of the seal, and wherein, upon a crimping of said seal, said outer cover member and said locking member are deformed whereby edges of the openings of the sheet metal locking member firmly grip the drawstring thereby forming individual anchoring points on the drawstring so as to prevent withdraw of the drawstring from the seal member and prevent unauthorized access to the container.

2. A tamperproof security seal according to claim 1, wherein the openings in the locking member are defined by a plurality of undulations formed in the locking member and extending from opposite sides of a plane of the locking member.

3. A tamperproof security seal according to claim 2, wherein the locking member is formed of sheet steel.

4. A tamperproof security seal according to claim 2, wherein the outer cover member is fashioned of a thermoplastic material.

5. A tamperproof security seal according to claim 4, wherein at least four rows of openings are provided in the locking member, with each row including at least two longitudinally spaced openings.

6. A tamperproof security seal according to claim 1, wherein the locking member is formed of a sheet steel.

7. A tamperproof security seal according to claim 1, wherein the outer cover member is fashioned of a thermoplastic material.

8. A tamperproof security seal according to claim 1, wherein at least four rows of openings are provided in the locking member, and wherein at least four openings are provided in each row.

9. A tamperproof security seal according to claim 1, wherein at least four rows of openings are provided in the locking member, and wherein at least seven openings are provided in each row.

* * * * *